US009951478B2

(12) United States Patent
Kuo et al.

(10) Patent No.: US 9,951,478 B2
(45) **Date of Patent: *Apr. 24, 2018**

(54) PULP MOLDING MACHINE AND PAPER-SHAPED ARTICLE MADE THEREBY

(71) Applicant: GOLDEN ARROW PRINTING CO., LTD., New Taipei (TW)

(72) Inventors: Chien-Kuan Kuo, New Taipei (TW); Chun-Huang Huang, New Taipei (TW)

(73) Assignee: GOLDEN ARROW PRINTING CO., LTD., New Taipei (TW)

( * ) Notice: Subject to any disclaimer, the term of this patent is extended or adjusted under 35 U.S.C. 154(b) by 38 days.

This patent is subject to a terminal disclaimer.

(21) Appl. No.: 14/965,171

(22) Filed: Dec. 10, 2015

(65) Prior Publication Data

US 2016/0168793 A1 Jun. 16, 2016

Related U.S. Application Data

(60) Provisional application No. 62/091,179, filed on Dec. 12, 2014.

(30) Foreign Application Priority Data

Nov. 12, 2015 (TW) ..... 104218168 U

(51) Int. Cl.
*D21J 3/12* (2006.01)
*D21J 3/00* (2006.01)

(52) U.S. Cl.
CPC .. *D21J 3/12* (2013.01); *D21J 3/00* (2013.01)

(58) Field of Classification Search
CPC ..... D21J 3/00; D21J 7/00; D21J 3/10; D21J 1/06; B26D 7/06; D21F 9/04; D21F 7/006
See application file for complete search history.

(56) References Cited

U.S. PATENT DOCUMENTS 3,287,208 A * 11/1966 Peppler ..... D21J 5/00 162/227
6,706,151 B1 * 3/2004 Oosthuizen ..... D21J 5/00 162/116

(Continued)

FOREIGN PATENT DOCUMENTS

CN 1214390 A * 4/1999
CN 1500939 A * 6/2004

(Continued)

*Primary Examiner* — Jose A Fortuna
(74) *Attorney, Agent, or Firm* — Osha Liang LLP

(57) ABSTRACT

A pulp molding machine and a paper-shaped article made thereby are provided. The pulp molding machine comprises a machine frame body, a pulp-dredging stage, a compression thermo-forming stage and an edge-cutting stage disposed on the machine frame body. The pulp-dredging stage comprises a paper slurry tank, a first upper mold and a first lower mold, a wet pulp is dredged up by the first lower mold from the paper slurry tank, and is pre-compressed by and between the first upper mold and the first lower mold to form a first semi-finished product. The compression thermo-forming stage comprises a second upper mold and a second lower mold, the first semi-finished product is thermo-compressed by and between the second upper mold and the second lower mold to form a second semi-finished product. The edge-cutting stage is utilized for cutting superfluous edges of the second semi-finished product to form a paper-shaped article.

13 Claims, 4 Drawing Sheets

(56) References Cited

U.S. PATENT DOCUMENTS

| | | | | |
|---|---|---|---|---|
| 6,752,910 | B2 * | 6/2004 | Sato | D21J 3/10 162/396 |
| 7,591,927 | B2 * | 9/2009 | Kim | B31D 5/02 162/147 |
| 8,795,474 | B2 * | 8/2014 | Lang | D21J 3/00 162/382 |
| 9,149,948 | B2 * | 10/2015 | Kuo | B25J 9/0084 |
| 9,556,563 | B1 * | 1/2017 | Yang | D21J 7/00 |
| 9,650,746 | B2 * | 5/2017 | Kuo | D21J 3/12 |
| 9,663,898 | B2 * | 5/2017 | Zhang | D21F 9/04 |
| 2003/0111201 | A1 * | 6/2003 | Sato | D21J 3/10 162/382 |
| 2004/0045690 | A1 * | 3/2004 | Eto | D21J 7/00 162/225 |
| 2007/0227680 | A1 * | 10/2007 | Kim | B31D 5/02 162/218 |
| 2013/0228301 | A1 * | 9/2013 | Lang | D21J 3/00 162/231 |
| 2014/0041498 | A1 * | 2/2014 | Kuo | B25J 9/0084 83/152 |
| 2015/0007954 | A1 * | 1/2015 | Huang | B65D 1/225 162/111 |
| 2015/0292154 | A1 * | 10/2015 | Zheng | D21J 5/00 162/226 |
| 2016/0010285 | A1 * | 1/2016 | Kuo | D21J 3/00 162/219 |
| 2016/0090694 | A1 * | 3/2016 | Zhang | D21J 3/00 162/217 |
| 2016/0168793 | A1 * | 6/2016 | Kuo | D21J 3/12 162/227 |
| 2016/0168800 | A1 * | 6/2016 | Kuo | D21J 3/00 162/218 |
| 2016/0168801 | A1 * | 6/2016 | Kuo | D21J 3/00 162/194 |
| 2016/0244917 | A1 * | 8/2016 | Kuo | D21J 3/00 |
| 2016/0362845 | A1 * | 12/2016 | Kuo | D21H 21/18 |
| 2016/0368235 | A1 * | 12/2016 | Kuo | B31B 43/00 |

FOREIGN PATENT DOCUMENTS

| | | | | |
|---|---|---|---|---|
| CN | 101914858 | A * | 12/2010 | |
| CN | 102465477 | A * | 5/2012 | |
| CN | 202644610 | U * | 1/2013 | |
| CN | 103015273 | A * | 4/2013 | D21J 5/00 |
| CN | 103526649 | A * | 1/2014 | |
| CN | 103556546 | A * | 2/2014 | |
| CN | 203420179 | U * | 2/2014 | |
| GB | 2413301 | A * | 10/2005 | D21J 1/06 |
| WO | WO 0058557 | A1 * | 10/2000 | D21J 5/00 |
| WO | WO 2005012640 | A1 * | 2/2005 | D21J 7/00 |

* cited by examiner

PULP MOLDING MACHINE AND PAPER-SHAPED ARTICLE MADE THEREBY

CROSS-REFERENCES

This application claims the benefit of U.S. Provisional Patent Application No. 62/091,179 filed Dec. 12, 2014, the contents of which is incorporated herein by reference in its entirety.

FIELD OF THE INVENTION

The present invention relates to a pulp molding technology, and more particularly to a pulp molding machine which performs a pre-compression process to drain off water or vapor from the wet pulp with high water content for improving production efficiency in following compression thermo-forming process and shortening the production time, and also particularly to a paper-shaped article made by the pulp molding machine with high surface smoothness of both inner and outer surfaces.

BACKGROUND OF THE INVENTION

Traditionally, a sponge or foam used in the inner packaging or outer packaging of a product for protection and shockproof is gradually replaced by a pulp molding article molded by pulp. The pulp molding article (or paper-shaped product) uses pulp as raw material and dredged the pulp, compressed the pulp by the molds for forming the same. The pulp molding article can be recycled and remanufactured so as to comply with the trend of energy conservation and carbon reduction.

A conventional pulp molding machine for forming a paper shape product is divided into two separate operation machine, including a molding machine and a shaping machine and do not linked to each other. The automatic production line cannot be maintained in a consistent continuous operation, so that a semi-finished product must rely on artificial means to deliver between the molding machine and the shaping machine. Moreover, the molding machine for forming a paper shape product comprises a pulp-dredging stage and a thermo-forming stage. In the pulp-dredging stage, a plurality of molds is used for dredging a wet pulp from a paper slurry tank. During the thermo-forming stage, the plurality of molds is compressed and heated so as to decrease the humidity of the wet pulp and obtain the semi-finished product. Thereafter, the shaping machine is used for cutting superfluous edges of the semi-finished product to form the pulp molding article.

In addition, the conventional pulp molding machine reduces the moisture contained in the wet pulp only by the thermo-forming stage at once. After the pulp-dredging stage, the wet pulp in the molds contains a high proportion of the moisture content (more than 50% of the overall weight). In the following molding process, it always takes a very long cycle time to drain off water or vapor from the wet pulp compressed between the molds, such as the thermo-forming stage takes about 160 seconds to drain off water or vapor from the wet pulp for obtaining the semi-finished product/the pulp molding article. This invokes a low production efficiency in mass. Furthermore, it is very easily to crash structure of the pulp molding article during the thermo-forming stage if a larger compression force is applied on the wet pulp at once. Accordingly, only once of the thermo-forming stage processed by the conventional pulp molding machine leads to a lower production efficiency in mass and easily to crash structure of the pulp molding article.

Therefore, it is necessary to provide a pulp molding machine and a paper-shaped article to solve the above problems, such as to shorten the production time of the thermo-forming stage and maintain the integrity of the semi-finished product/the pulp molding article.

SUMMARY OF THE INVENTION

In order to solve the aforementioned drawbacks of the prior art, the present invention provides a pulp molding machine for shortening the production time of forming the semi-finished/the pulp molding article. The pulp molding machine of the present invention performs a pre-compression process to drain off water or vapor from the wet pulp with high water content between a first upper mold and a first lower mold during a pulp-dredging stage. That can reduce the water or vapor content in the wet pulp before performing a compression thermo-forming stage for preventing easily to crash the structure of the pulp molding article during the compression thermo-forming stage if a larger compression force and thermal is applied on the wet pulp rapidly. Thus, pulp fibers within the wet pulp become denser, and then the wet pulp is thermo-compressed by and between a second upper mold and a second lower mold for shortening the production time of the compression thermo-forming stage and improving the production efficiency in mass.

An object of the present invention is to provide a pulp molding machine, comprising:

a machine frame body;

a pulp-dredging stage disposed on the machine frame body, comprising a paper slurry tank, a first upper mold and a first lower mold, a wet pulp is dredged up by the first lower mold from the paper slurry tank, the dredged wet pulp is pre-compressed by and between the first upper mold and the first lower mold, so as to form a first semi-finished product;

a compression thermo-forming stage disposed adjacent to the pulp-dredging stage on the machine frame body, comprising a second upper mold and a second lower mold, the first semi-finished product is thermo-compressed by and between the second upper mold and the second lower mold, so as to form a second semi-finished product; and an edge-cutting stage disposed on the machine frame body, comprising a chopper for cutting superfluous edges of the second semi-finished product to form a paper-shaped article.

In the pulp molding machine described above, when the first upper mold is moving downward in the manner close to the first lower mold, a first molding gap kept between the first upper mold and the first lower mold is greater than or equal to 1 mm and less than or equal to 5 mm.

In the pulp molding machine described above, when the second upper mold is moving downward in the manner close to the second lower mold, a second molding gap kept between the second upper mold and the second lower mold is less than or equal to 2 mm, and the second molding gap is less than the first molding gap.

In the pulp molding machine described above, the first lower mold dredges the wet pulp from the paper slurry tank, a period time of the first lower mold staying in the paper slurry tank for dredging the wet pulp is about 3.5 seconds and a period time of the first lower mold and the first upper mold pre-compressed with each other is about 3 seconds.

In the pulp molding machine described above, the first upper mold and the second upper mold are convex shaped molds, and the first lower mold and the second lower mold are concave shaped molds.

In the pulp molding machine described above, the pulp molding machine further comprises a driving device utilized for moving the first upper mold to the compression thermo-forming stage, so as to convey the first semi-finished product which is being suctioned by the first upper mold.

In the pulp molding machine described above, the pulp molding machine further comprises a driving device utilized for moving the second upper mold to the edge-cutting stage, so as to convey the second semi-finished product which is being suctioned by the second upper mold.

In the pulp molding machine described above, at least one through hole for releasing out water or vapor from the dredged wet pulp, the first semi-finished product and the second semi-finished product is respectively distributed within the first upper mold, the first lower mold, the second upper mold, and the second lower mold.

In the pulp molding machine described above, the pulp molding machine further comprises at least one suction device liquid-communicated with the respective through holes of the first upper mold, the first lower mold, the second upper mold, and the second lower mold for drawing out water or vapor.

In the pulp molding machine described above, the pulp molding machine further comprises at least one heater, which can be installed in either the second upper mold or the second lower mold for heating the molds to dry the first semi-finished product inside the respective molds.

In the pulp molding machine described above, the first upper mold and the first lower mold are made of aluminum, and the first lower mold further comprises a double layered first mesh disposed on an inner surface thereof for holding the wet pulp on the first mesh.

In the pulp molding machine described above, the second upper mold and the second lower mold are made of aluminum, the second upper mold further comprises a second mesh disposed under the bottom of a protrusion part of the second upper mold, and the second lower mold further comprises a second mesh disposed on a topper edge of the second lower mold.

In the pulp molding machine described above, the second lower mold is made of a porous metal material selected from the group consisting of sintered cooper, stainless steel and nickel alloy, and the second upper mold is made of aluminum.

In the pulp molding machine described above, the pulp molding machine further comprises a turnover pulp-dredging device installed in the first lower mold for driving the first lower mold to rotate 180 degrees.

In the pulp molding machine described above, the pulp molding machine further comprises a drawing device installed in the first lower mold for drawing the wet pulp from the paper slurry tank so that the wet pulp is absorbed and attached on a surface of the first lower mold.

Another object of the present invention is to provide A paper-shaped article made by pulp molding machine according to claims 1-14, comprising:

a smooth inner surface having a surface smoothness of the inner surface greater than 3 seconds according to Bekk Smoothness measurement; and a smooth outer surface having a surface smoothness of the outer surface greater than 3 seconds according to Bekk Smoothness measurement.

DETAILED DESCRIPTION OF THE PREFERRED EMBODIMENTS

Figure 1:
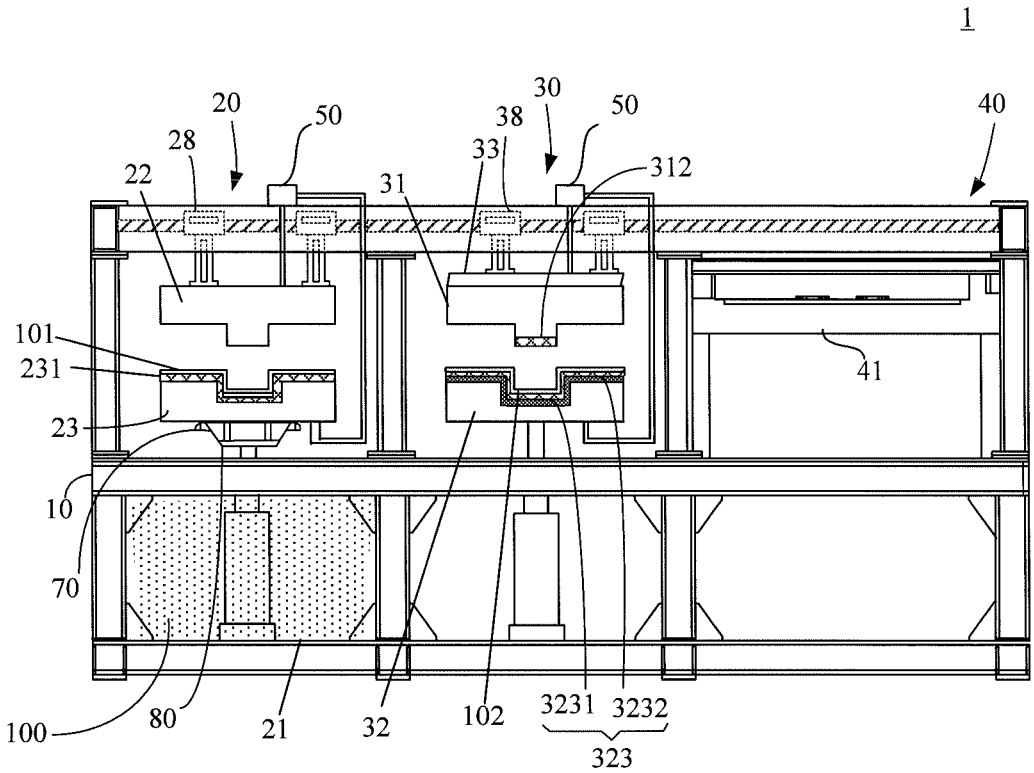
FIG. 1 is a schematic view of a pulp molding machine according to the present invention.

This description of the exemplary embodiments is intended to be read in connection with the accompanying drawings, which are to be considered part of the entire written description. In the description, terms such as "lower," "upper," "horizontal," "vertical,", "above," "below," "up," "down," "top", and "bottom" as well as derivatives thereof should be construed to refer to the orientation as then described or as shown in the drawing under discussion. These terms are for convenience of description and do not require that the apparatus be constructed or operated in a particular orientation, and do not limit the scope of the invention.

Referring to FIG. 1, which is a schematic view of a pulp molding machine according to the present invention. A pulp molding machine 1 of the present invention comprises a machine frame body 10, a pulp-dredging stage 20, a compression thermo-forming stage 30 and an edge-cutting stage 40.

The pulp-dredging stage 20 is disposed on the machine frame body 10, and comprises a paper slurry tank 21, a first upper mold 22 and a first lower mold 23. The paper slurry tank 21 contains slurry 100 which is dredged up by the first lower mold 23 from the paper slurry tank 21 to form a wet pulp. The dredged wet pulp is pre-compressed by and between the first upper mold 22 and the first lower mold 23, so as to form a first semi-finished product 101.

The compression thermo-forming stage 30 is disposed adjacent to the pulp-dredging stage 20 on the machine frame body 10. The compression thermo-forming stage 30 comprises a second upper mold 31 and a second lower mold 32. The first semi-finished product 101 is thermo-compressed by and between the second upper mold 31 and the second lower mold 32, so as to form a second semi-finished product 102.

Figure 6:
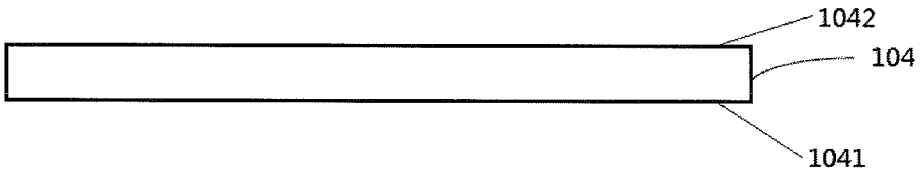
FIG. 6 is a cross-sectional view of a paper-shaped article made by the pulp molding machine according to the present invention.

The edge-cutting stage 40 is disposed adjacent to the compression thermo-forming stage 30 on the machine frame body 10. The edge-cutting stage 40 comprises a chopper 41 for cutting superfluous edges of the second semi-finished product 102 to form a paper-shaped article 104 (shown in FIG. 6).

The machine frame body 10 is fitted with two parallel extending guide rails, and a first driving device 28 and a second driving device 38 are installed on an upper side of the machine frame body 10. The first driving device 28 and the second driving device 38 can be selected from mechanical arms or guide screws driven by a motor.

In more detail, in this embodiment of the present invention, the first driving device 28 is installed in the pulp-dredging stage 20 for controlling the first lower mold 23 dredging the slurry 100 from the paper slurry tank 21 for forming the wet pulp. The first lower mold 23 further comprises a vacuum suction device 50 for collecting/dredging up the slurry 100 from a paper slurry tank 100. A surface of the first lower mold 23 is covered with the dredged slurry 100. A period time of the first lower mold 23 staying in the paper slurry tank 21 for dredging the wet pulp is about 3.5 seconds. Thereafter, the first lower mold 23 is away from the paper slurry tank 21 to finish the pulp-dredging process. The slurry 100 dredged up from a paper slurry tank 100 forms the wet pulp which is disposed on the first lower mold 23. The first lower mold 23 and the first upper mold 22 mutually clamp for performing a pre-compression forming sub-stage toward the dredged wet pulp. The pre-compression forming sub-stage is lasting about 3 seconds. In addition, when the first upper mold 22 is moving downward in the manner close to the first lower mold 23, a first molding gap kept between the first upper mold 22 and the first lower mold 23 is greater than or equal to 1 mm and less than or equal to 5 mm, 3 mm is preferably, but not limited thereto. After the pre-compression forming sub-stage, the wet pulp formed by the slurry 100 is converted to the first semi-finished product 101. A dryness of the first semi-finished product 101 is 10%-50%, preferably is 33%, but not limited thereto.

In this embodiment of the present invention, the first upper mold 22 and the first lower mold 23 comprise at least one through hole respectively for releasing out water or vapor from the dredged wet pulp. The through holes are distributed within inner surfaces of the first upper mold 22 and the first lower mold 23 and penetrate the first upper mold 22 and the first lower mold 23, respectively. Thus, water or vapor drained off from the wet pulp can be released out via the through holes. Besides, the vacuum suction device 50 is liquid-communicated with the respective through holes of the first upper mold 22 and the first lower mold 23 for drawing out water or vapor. The vacuum suction device 50 is a vacuum pump for drawing out water or vapor within the first upper mold 22 and the first lower mold 23 through the through holes.

In this embodiment of the present invention, the first upper mold 22 is a convex shaped mold. That is to say, a protrusion portion is formed in the central portion of the first upper mold 22. The first lower mold 23 is a concave shaped mold. The first upper mold 22 and the first lower mold 23 are made of aluminum. The first upper mold 22 comprises a first inner surface and a first mesh 231 disposed on the first inner surface thereof. The first mesh 231 is a double layered mesh structure which comprises a first inner mesh and a first outer mesh. A mesh count of the first outer mesh is greater than a mesh count of the first outer mesh for holding the wet pulp on the first mesh 231 without sticking the wet pulp into the through holes. As the vacuum suction device 50 draws out water or vapor from the wet pulp through the through holes, the wet pulp can be held on the first lower mold 23 rather than inhaled into the through holes.

After the pulp-dredging process, the first upper mold 22 is moved by at least one automatic arm or sliding rack (alone a horizontal and vertical directions in turn or together) of the machine frame body 10, from the pulp-dredging stage 20 to the compression thermo-forming stage 30, so as to convey the first semi-finished product 101 which is being suctioned by the first upper mold 22. Thereafter, the first semi-finished product 101 is thermo-compressed by and between the second upper mold 31 and the second lower mold 32. The wet pulp molding machine 1 further comprises at least one heater 33 (such as a heating plate), which can be attached to or be installed in either the second upper mold 31 or the second lower mold 32 for heating the molds to dry the first semi-finished product 101 inside the respective molds. After the first semi-finished product 101 is thermo-compressed by and between the second upper mold 31 and the second lower mold 32, the first semi-finished product 101 is converted to a second semi-finished product 102. In the compression thermo-forming stage 30, a temperature of the heater 33 is controlled in a range of 100° C. to 180° C., and 120° C. is preferably, but not limited thereto. When the second upper mold 31 is moving downward in the manner close to the second lower mold 32, a second molding gap kept between the second upper mold 31 and the second lower mold 32 is less than or equal to 2 mm, and the second molding gap is less than the first molding gap. A dryness of the second semi-finished product 102 is 50%-100%.

For the same structure as the first upper mold 22 and the first lower mold 23 mentioned above, referring to FIG. 2 and FIG. 3, the second upper mold 31 and the second lower mold 32 comprise at least one through hole 34 respectively for releasing out water or vapor from the first semi-finished product 101. The through holes 34 are distributed within inner surfaces of the second upper mold 31 and the second lower mold 32 and penetrate the second upper mold 31 and the second lower mold 32, respectively. Thus, water or vapor drained off from the wet pulp can be released out via the through holes 34. Besides, the vacuum suction device 50 is liquid-communicated with the respective through holes 34 of the second upper mold 31 and the second lower mold 32 for drawing out water or vapor. The vacuum suction device 50 is a vacuum pump for drawing out water or vapor within the second upper mold 31 and the second lower mold 32 through the through holes 34.

The through hole 34 is formed on the corresponding mold by at least one machining process, including, for example, a wire-cutting, a laser machining, a grinding, an electrical discharge machining processes and so on. In different embodiment of the present invention, the through hole 34 is formed integrally with the corresponding mold by metallic casting/sintering process.

Figure 2:
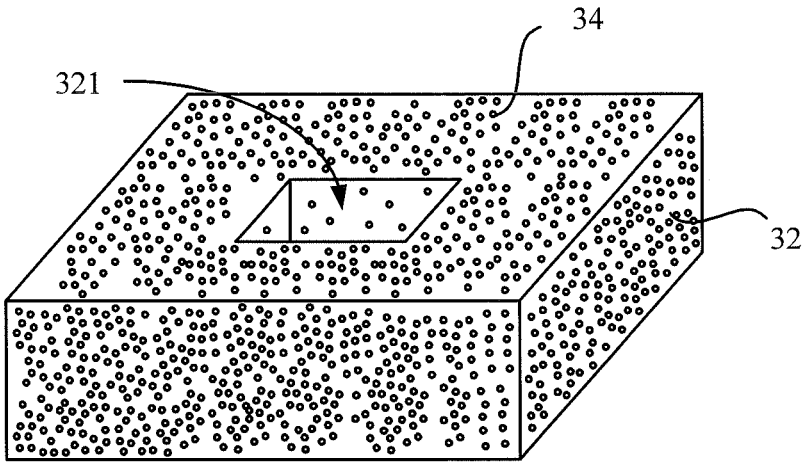
FIG. 2 is a schematic view of a second upper mold of the pulp molding machine according to the present invention.
Figure 3:
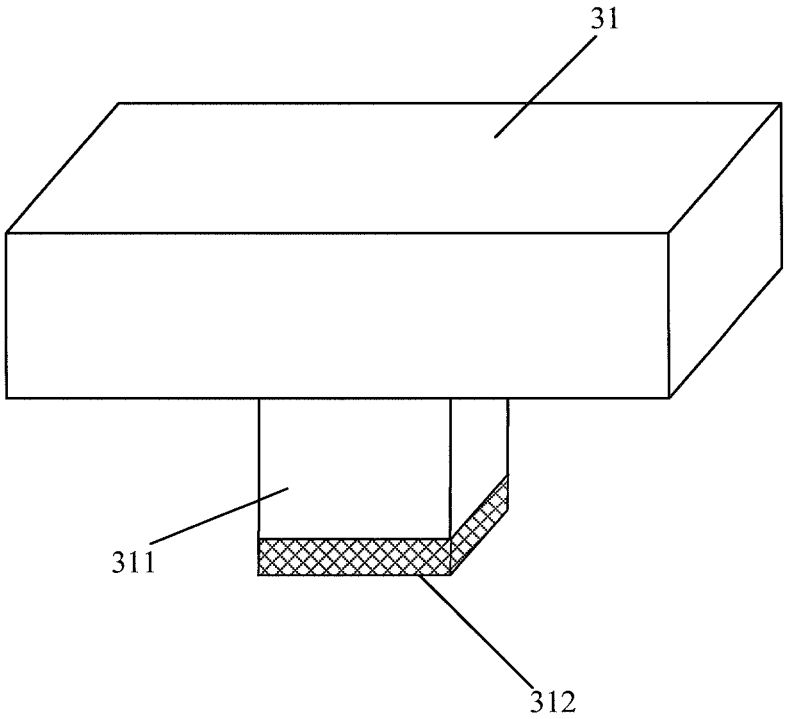
FIG. 3 is a schematic view of a second lower mold of the pulp molding machine according to the present invention.

Referring to FIG. 1 to FIG. 3, the second upper mold 31 is a convex shaped mold. Namely, a protrusion portion 311 is formed in a central portion of the second upper mold 31. The second lower mold 32 is a concave shaped mold. Namely, a groove 321 is formed in a central portion of the second lower mold 32. The second upper mold 31 further comprises a second upper mesh 312 disposed under the bottom of the protrusion portion 311 of the second upper mold 31, and the second lower mold 32 further comprises a second lower mesh 323 disposed on a topper edge of the second lower mold 32. The second lower mesh 323 is a double layered mesh structure which comprises a second inner lower mesh 3231 and a second outer upper mesh 3232 (as shown in FIG. 1). A mesh count of the second outer upper mesh 3232 is greater than a mesh count of the second inner lower mesh 3231. Thus, a space between the first semi-finished product 101 and the second lower mold 32 is broadened for increasing the efficiency of drawing out water or vapor from the first semi-finished product 101 and further for holding the first semi-finished product 101 on the second lower mesh 323. Meanwhile, as the vacuum suction device 50 draws out water or vapor contained in the first semi-finished product 101 through the through holes, the first semi-finished product 101 can be held on the second lower mold 32, without sticking fibers of the first semi-finished product 101 into the through holes 34 and prevent the first semi-finished product 101 attaching to the second lower mold 32.

In different embodiment of the present invention, the second upper mold 31 and the second lower mold 32 are made of aluminum/any other metal having a higher smoothness on its molding surface. The second lower mold 32 can be replaced by the porous metal material selected from the group consisting of sintered cooper, stainless steel and nickel alloy, and the second upper mold 31 is made of aluminum/any other metal having a higher smoothness on its molding surface. Since the second lower mold 32 is made of the porous metal material, the upper second mold 31 which corresponding to the second lower mold 32 is made of aluminum without the second lower mesh 323 as described in the previous embodiment. Thus, the paper-shaped article 104 comprises a smooth inner surface 1041 and a smooth outer surface 1042. Both the smooth inner surface 1041 and the smooth outer surface 1042 have a surface smoothness of the inner surface greater than 3 seconds according to Bekk Smoothness measurement, and 6-14 seconds according to Bekk Smoothness measurement is preferably.

Figure 4:
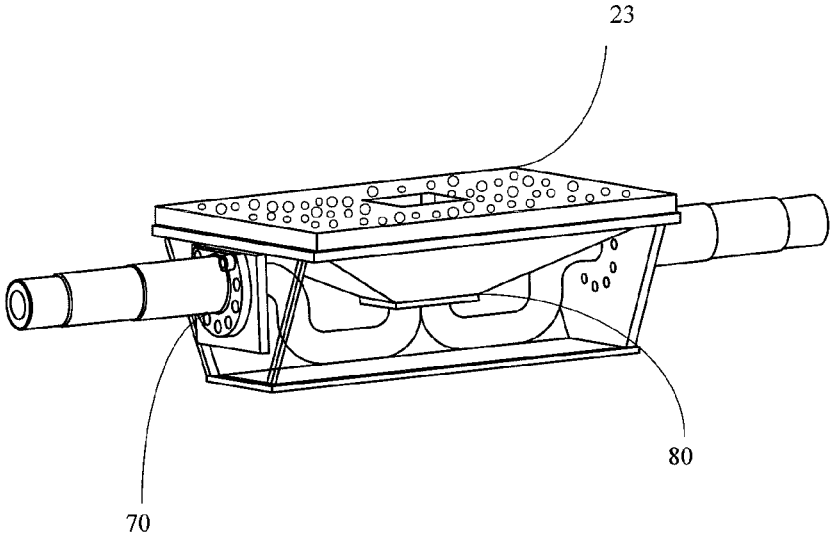
FIG. 4 is a schematic view of a turnover pulp-dredging device installed in the first lower mold of the pulp molding machine according to the present invention.

Referring to FIG. 4, in different embodiment of the present invention, the pulp molding machine 1 further comprises a turnover pulp-dredging device 70 installed in the first lower mold 23. The turnover pulp-dredging device 70 comprises an inversion driving element. The inversion driving element comprises a rotating shaft disposed at one end of its rotation axis, and another end of the inversion driving element is penetrated into the first lower mold 23 for driving the first lower mold 23 to rotate 180 degrees. The rotating shaft is driven and rotated by the inversion driving element, and the first lower mold 23 is driven by the rotating shaft to rotate 180 degrees. Besides, the pulp molding machine 1 further comprises a drawing device 80 installed in the first lower mold 23 for drawing/absorbing the wet pulp dredged from the paper slurry tank 21 so that the wet pulp is absorbed and attached on a surface of the first lower mold 23. Therefore, there are two manners for the pulp molding machine 1 to dredge/draw up the slurry 100 from the paper slurry tank 21. The first one is in a manner of collecting/dredging up the slurry 100 from the paper slurry tank 21 for forming the wet pulp (i.e. a surface of the first lower mold 23 upward for collecting/dredging up the slurry 100 from the paper slurry tank 21). Another one manner is the first lower mold 23 driven by the turnover pulp-dredging device 70 to rotate 180 degrees, so that surface of the first lower mold 23 is downward for drawing/absorbing the slurry 100 from the paper slurry tank 21.

The difference between the manner of drawing/absorbing the slurry 100 and the manner of collecting/dredging up the slurry 100 is as follows. The fibers of the slurry 100 deposited in the bottom of the first lower mold 23 present different deposition situations. For example, in the drawing/absorbing manner, the fibers of the slurry 100 nearby the first mesh 231 will be relatively short due to the suction effect. That is, the shorter fibers of the slurry 100 will be absorbed and deposited in the bottom of the first lower mold 23 after the first lower mold 23 rotating 180 degrees (a upper surface of the first lower mold 23 downwardly). Also, the longer fibers of the slurry 100 will be deposited away from the bottom of the first lower mold 23. Thus, each corner of the paper-shaped article 104 presents a finer rectangular status. With respect to the collecting/dredging manner, the fibers of the slurry 100 deposited in the bottom of the first lower mold 23 is only forced by the gravity. The longer fibers of the slurry 100 will be deposited in the bottom of the first lower mold 23. That result in each corner of the paper-shaped article 104 presents an obtuse state, such as unsightly corners or rounded corners.

After the compression thermo-forming stage 30, the first semi-finished product 101 is converted to a second semi-finished product 102. the second upper mold 31 is moved by at least one automatic arm or sliding rack (alone a horizontal and vertical directions in turn or together) of the machine frame body 10, from the compression thermo-forming stage 30 to the edge-cutting stage 40, so as to convey the second semi-finished product 102 which is being suctioned by the second upper mold 31.

The second driving device 38 is installed on an upper side of the machine frame body 10. The machine frame body 10 is fitted with two parallel extending guide rails. The second driving device 38 can be selected from mechanical arms or guide screws driven by a motor. In different embodiment of the present invention, the second driving device 38 is a combination of a slide rail and a slide rail block, which is a conventional device and technology and will not repeat herein.

Figure 5:
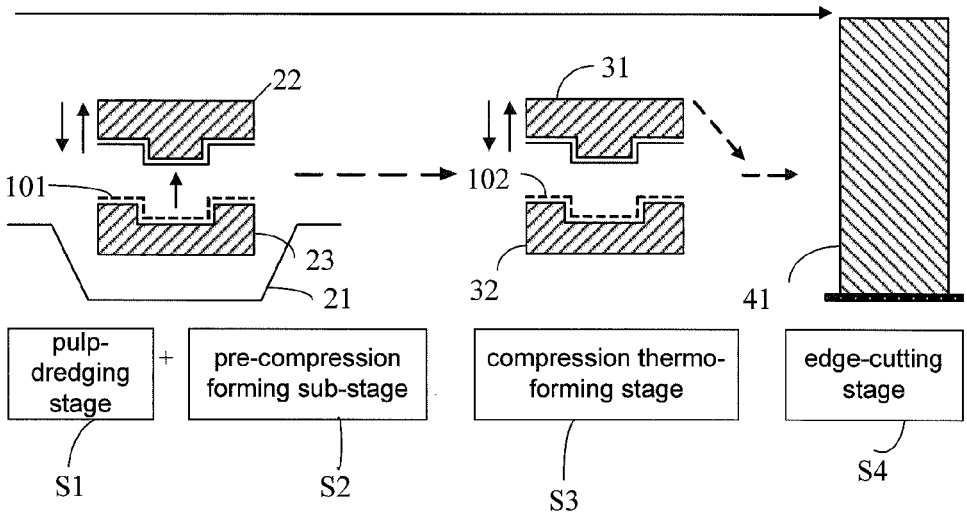
FIG. 5 is a schematic view of the movement of the pulp molding machine according to the present invention.

Referring to FIG. 5 with FIGS. 1-3, FIG. 5 is a schematic view of the movement of the pulp molding machine according to the present invention.

The present invention further provides a pulp molding process of using the aforementioned pulp molding machine, comprising the following steps as follows.

In a step S01, a pulp-dredging step corresponding to the pulp-dredging stage, which is applied to collect/dredge up the slurry from the paper slurry tank and including a first pre-compression forming step which is further applied on the dredged wet pulp by and between the first upper mold and the first lower mold, both kept in a first molding gap therebetween, so as to form a first semi-finished product, wherein a dryness of the first semi-finished product is about 10%~50%.

Besides, the first lower mold is sunk downwardly into the paper slurry tank to collect/dredge up the slurry above the first lower mold by the first driving device (i.e. a feeding shaft) disposed in the pulp-dredging stage. The first lower mold is moved upward by the first driving device to a predetermined position, and then the first upper mold is moved downward by a first vertical rack of the machine frame body in a manner close to the first lower mold, accompanying with performing the first pre-compression forming step where the first upper mold downwardly applies a first compressing force on the dredged wet pulp by and between the first upper mold and the first lower mold, both kept in the first molding gap therebetween. The first molding gap is greater than or equal to 1 mm and less than or equal to 5 mm, 3 mm is preferably.

After performing the first pre-compression forming step, water/vapor is drew out of the wet pulp inside the first lower mold and the wet pulp is sucked to the first upper mold by the suction device, so as to form the first semi-finished product.

The first upper mold is moved upward to an initial position of the pulp-dredging stage and is horizontally conveyed the first upper mold by a first horizontal sliding rack of the machine frame body, from the first pre-compression forming stage of the pulp-dredging stage to the compression thermo-forming step, so as to convey the first semi-finished product which is being suctioned by the first upper mold. The cycle time of step S01 is below 10 seconds.

The first upper mold is moved downward to the determine position to place the first semi-finished product over the second lower mold. The first upper mold is moved back to the pulp-dredging stage.

In a step S02, a compression thermo-forming step corresponding to the compression thermo-forming stage, which is further applied on the first semi-finished product by and between the second upper mold and the second lower mold, both kept in a second molding gap therebetween and less than the first molding gap, so as to form a second semi-finished product.

Thereafter, the second upper mold is moved downwardly in a manner close to the second lower mold, accompanying with applying a second compressing force on the first semi-finished product by and between the second upper mold and the second lower mold, both kept in the second molding gap therebetween and less than the first molding gap. In this embodiment of the present invention, the second molding gap is about 0~2 mm.

In the step S02, the first semi-finished product located above the second lower mold is heated by the heater, and the heater draws the water/vapor out from the first semi-finished product between the second upper and second lower molds, so as to form the second semi-finished product. A heating time of the step S02 is 10 seconds with a heating temperature between 100~180° C., and 120° C. is preferably. Then, the second semi-finished product is sucked to the second upper mold by the suction device. At this time, a dryness of the second semi-finished product is 50%-100%.

The second upper mold is moved upward by a second vertical sliding rack of the machine frame body to the initial position of the compression thermo-forming stage and the second upper mold is horizontally conveyed with the second semi-finished product to the edge-cutting stage by a second horizontal sliding rack of the machine frame body. The cycle time of step S02 is below 160 seconds.

In a step S03, an edge-cutting step corresponding to the edge-cutting stage, which is further applied on the second semi-finished product by a chopper to form a finished product.

In the step S03, a mechanical chopper or a laser cutter is used to cut edges of the second semi-finished product so as to form the finish product as a paper shape product (i.e. 3C product box).

The present invention has disclosed that the pulp molding machine and the paper-shaped article made by the pulp molding machine are able to solve the problems of lower production efficiency in mass caused by the time consuming of the thermo-forming step and the pulp molding article crashing easily. For solving the problems mentioned above, the pulp molding machine of the present invention combines the molding machine with the shaping machine, and performs the molding process in the manner of automatic production for continuous operation via the driving device, automatic arm or sliding rack without conveying the semi-finished products by artificial means. Additionally, the pulp molding machine applies the pre-compression forming sub-stage on the dredged wet pulp by and between the first upper mold and the first lower mold for drawing out the water/vapor contained in the wet pulp. That can reduce the water or vapor content in the wet pulp before performing a compression thermo-forming stage for preventing easily to crash the structure of the pulp molding article during the compression thermo-forming stage if a larger compression force and thermal is applied on the wet pulp rapidly. Thus, pulp fibers within the wet pulp become denser, and then the wet pulp is thermo-compressed by and between a second upper mold and a second lower mold for shortening the production time of the compression thermo-forming stage and improving the production efficiency in mass.

The present invention has been described with preferred embodiments thereof, and it is understood that many changes and modifications to the described embodiments can be carried out without departing from the scope and the spirit of the invention that is intended to be limited only by the appended claims.

What is claimed is:

1. A pulp molding machine, comprising:

a machine frame body;

a pulp-dredging stage disposed on the machine frame body, comprising a paper slurry tank, a first upper mold and a first lower mold, a wet pulp is dredged up by the first lower mold from the paper slurry tank, the dredged wet pulp is pre-compressed by and between the first upper mold and the first lower mold, so as to form a first semi-finished product;

a compression thermo-forming stage disposed adjacent to the pulp-dredging stage on the machine frame body, comprising a second upper mold and a second lower mold, the first semi-finished product is thermo-compressed by and between the second upper mold and the second lower mold, so as to form a second semi-finished product; and an edge-cutting stage disposed on the machine frame body, comprising a chopper for cutting superfluous edges of the second semi-finished product to form a finished product;

wherein the first upper mold is configured to move downward to the first lower mold, and wherein a first molding gap between the first upper mold and the first lower mold is greater than or equal to 1 mm and less than or equal to 5 mm; and wherein the second upper mold further comprises a second upper mesh disposed under a bottom of a protrusion part of the second upper mold, and the second lower mold further comprises a second lower mesh disposed on a top edge of the second lower mold.

2. The pulp molding machine according to claim 1, wherein when the second upper mold is moving downward in the manner close to the second lower mold, a second molding gap kept between the second upper mold and the second lower mold is less than or equal to 2 mm, and the second molding gap is less than the first molding gap.

3. The pulp molding machine according to claim 1, wherein the first upper mold and the second upper mold are convex shaped molds, and the first lower mold and the second lower mold are concave shaped molds.

4. The pulp molding machine according to claim 1, wherein the pulp molding machine further comprises a driving device utilized for moving the first upper mold to the compression thereto-forming stage, so as to convey the first semi-finished product which is being suctioned by the first upper mold.

5. The pulp molding machine according to claim 1, wherein the pulp molding machine further comprises a driving device utilized for moving the second upper mold to the edge-cutting stage, so as to convey the second semi-finished product which is being suctioned by the second upper mold.

6. The pulp molding machine according to claim 1, wherein a plurality of through holes for releasing out water or vapor from the dredged wet pulp are distributed within the first upper mold, the first lower mold, the second upper mold, and the second lower mold.

7. The pulp molding machine according to claim 6, wherein the pulp molding machine further comprises at least one suction device in fluid communication with the respective through holes of the first upper mold, the first lower mold, the second upper mold, and the second lower mold for thawing out water or vapor.

8. The pulp molding machine according to claim 1, wherein the pulp molding machine further comprises at least one heater, the heater is installed in either the second upper mold or the second lower mold for heating the molds to dry the first semi-finished product inside the respective molds.

9. The pulp molding machine according to claim 1, wherein the first upper mold and the first lower mold are made of aluminum, the first lower mold further comprises a double layered first mesh disposed on an inner surface thereof for holding the wet pulp on the first mesh.

10. The pulp molding machine according to claim 1, wherein the second upper mold and the second lower mold are made of aluminum.

11. The pulp molding machine according to claim 1, wherein the second lower mold is made of a porous metal material selected from the group consisting of sintered cooper, stainless steel and nickel alloy, and the second upper mold is made of aluminum.

12. The pulp molding machine according to claim 1, wherein the pulp molding machine further comprises a turnover pulp-dredging device installed in the first lower mold for driving the first lower mold to rotate 180 degrees.

13. The pulp molding machine according to claim 12, wherein the pulp molding machine further comprises a drawing device installed in the first lower mold for drawing the wet pulp from the paper slurry tank so that the wet pulp is absorbed and attached on a surface of the first lower mold.

* * * * *